US006929064B1

(12) United States Patent
Susman

(10) Patent No.: US 6,929,064 B1
(45) **Date of Patent: *Aug. 16, 2005**

(54) DOWNHOLE PUMP

(76) Inventor: Hector Fillipus Alexander Von Drentham Susman, c/o Rotech Whitemyres Avenue, Mastrick Industrial Estate, Aberdeen (GB) AB 16 6HQ ( * ) Notice: Subject to any disclaimer, the term of this patent is extended or adjusted under 35 U.S.C. 154(b) by 0 days.

This patent is subject to a terminal disclaimer.

(21) Appl. No.: 10/018,219

(22) PCT Filed: Jun. 16, 2000

(86) PCT No.: PCT/GB00/02350

§ 371 (c)(1),
(2), (4) Date: Feb. 26, 2002

(87) PCT Pub. No.: WO00/79132

PCT Pub. Date: Dec. 28, 2000

(30) Foreign Application Priority Data

Jun. 18, 1999 (GB) ..... 9914150

(51) Int. Cl.[7] ..... E21B 43/00; F04B 19/02
(52) U.S. Cl. ..... 166/105; 166/68; 166/68.5; 166/372; 417/462; 417/487; 417/488
(58) Field of Search ..... 166/68.5, 105, 166/109, 110, 108, 68; 417/487, 488, 462

(56) References Cited

U.S. PATENT DOCUMENTS 462,033 A * 10/1891 Cleveland ..... 218/89
1,403,699 A 1/1922 Loewenthal et al.
1,980,985 A * 11/1934 Deming ..... 418/13
2,060,493 A 11/1936 Fillmore
2,462,732 A * 2/1949 Dusevoir ..... 418/135
2,909,126 A * 10/1959 Gordon ..... 417/488

(Continued)

FOREIGN PATENT DOCUMENTS

EP 0713965 A1 5/1996

(Continued)

OTHER PUBLICATIONS

Dietmar Findeisen and Franz Findeisen, Olhydraulik, 1994, pp 230-234, Springer-Verlag, Berlin.

*Primary Examiner*—David Bagnell
*Assistant Examiner*—Giovanna Collins
(74) *Attorney, Agent, or Firm*—The HT Than Law Group

(57) ABSTRACT

There is disclosed an improved pump (5, 5') particularly suitable for use in a method of "artificial lift" in an oil/gas well. Known pumps used in artificial lift methods suffer from a number of problems/disadvantages—e.g. low efficiency (hydraulic efficiency). The disclosed embodiments of the invention provide a pump (5, 5') which provides a positive displacement of a predetermined volume of well production fluid for each operative cycle of the pump-in contra-distinction known to pumps which provide axial flow of well production fluid. The inventive pump (5, 5') provides a chamber (10, 10') having a volume (V, V'), an inlet (15) to the chamber (10, 10'), an outlet (20) from the chamber (10, 10'), and means for varying the volume (V, V') of the chamber (10, 10'). The means for varying the volume (V, V') of the chamber (10, 10') is controlled by relative rotation of first and second bodies (30, 35, 30', 35').

60 Claims, 5 Drawing Sheets

U.S. PATENT DOCUMENTS 3,804,557 A * 4/1974 Bentley ..... 417/402
4,522,174 A 6/1985 Babitzka et al.
4,530,324 A 7/1985 Tanaka et al.
4,564,341 A 1/1986 Tanaka
4,930,994 A * 6/1990 Budecker ..... 417/286
5,064,536 A * 11/1991 Bratten ..... 210/402
5,409,360 A * 4/1995 Wycliffe ..... 418/258
5,494,102 A * 2/1996 Schulte ..... 166/105.6
5,501,580 A * 3/1996 Barrus et al. ..... 417/410.3
5,779,901 A 7/1998 Mosca

FOREIGN PATENT DOCUMENTS

GB 2310254 A 8/1977
GB 2310254 * 8/1997
JP 59029788 2/1984
WO WO 98/14695 A1 4/1998
WO WO 99/20904 A1 4/1999

* cited by examiner $5_1$
$5_2$
120
160
25
15
50
75
35
10
80
69
65
30
7A
7B
60
45
40
85
55
20
100
90
95
105
110
116
115
70

DOWNHOLE PUMP

BACKGROUND OF THE INVENTION

This invention relates to pumps, and in particular, though not exclusively, to a pump for use in the oil/gas and/or chemical industries. A pump of the present invention is particularly suitable for use in a method of "artificial lift" in an oil/gas well.

In many oil wells the oil does not have enough pressure to flow all the way up the tubing to the surface. The produced water and oil has to be lifted up the tubing to the surface by one of several methods, normally called artificial lift. Even with a flowing oil well, as more fluids are removed from the subsurface reservoir, the pressure on the remaining oil decreases until it no longer flows up the tubing to the surface.

A common artificial lift apparatus is the sucker-rod pump system. The sucker-rod pump or rod-pumping system uses a downhole rod pump, a surface pumping unit, and a sucker-rod string that runs down the well to connect them. The sucker-rod pump has a standing valve and travelling valve. The travelling valve reciprocates up and down while the standing valve remains stationary.

The sucker-rod pump system suffers from a number of problems. Fluid pound is a problem caused when the produced liquid is pumped faster than it is flowing into the well. Gas enters the pump and the pump can be damaged. Gas lock is an extreme case of fluid pound. Gas accumulates in the pump and prevents the pump from working.

An artificial lift method used on wells that produce large volumes of liquid is gas lift. In a gas lift well, a compressed inert gas called lift gas (usually natural gas that was produced from the well) is injected into the annulus in the well between the casing and tubing. Gas lift valves—pressure valves that open and close—are spaced along the tubing string. They allow the gas to flow into the tubing, where it dissolves in the liquid and also forms bubbles. This lightens the liquid and, along with the expanding bubbles, forces the produced liquid up the tubing string to the surface where the gas can be recycled. The advantages of gas lift is that there is very little surface equipment and few moving parts. Gas lift is a very inexpensive technique when many wells are serviced by only one central compressor facility. However, it is effective only in relatively shallow wells. Offshore oil wells and crooked or deviated wells that need artificial lift are usually completed with gas lift. Gas lift is either continuous or intermittent (periodically on and off) for wells with low production.

Artificial lift may also be provided by means of a submersible electrical pump. A submersible electrical pump normally uses an electric motor that drives a centrifugal pump with a series of rotating blades on a shaft located on the bottom of the tubing. An armoured electrical cable runs up the well, strapped to the tubing string. Electricity is supplied by a transformer on the surface. The electric motor has a variable speed that can be adjusted for lifting different volumes of liquids. Submersible electrical pumps are used for lifting large volumes of liquid and for crooked and deviated wells. A gas separator is often used on the bottom of the pump to prevent gas from forming in the pump and decreasing the pump's efficiency. Prior art electrical pumps are therefore coupled to a turbine or the like and provide axial flow of fluid.

A hydraulic pump may also be used to provide artificial lift. A known hydraulic pump is identical to a sucker-rod pump except it is driven by hydraulic pressure from a fluid pumped down the well. It uses two reciprocating pumps. One pump on the surface injects a high pressure power oil (usually crude oil from a storage tank) down a tubing string in the well. A reciprocating hydraulic motor on the bottom of the tubing is driven by the power oil. It is coupled to a pump, similar to a sucker-rod pump, and located below the fluid level in the well. The motor drives the pump, which lifts both the spent power oil and the produced fluid from the well up another tubing string. The power fluid causes the upstroke and the release of pressure causes the downstroke. It is called a parallel-free pump. In another variation, (casing-free pump), the power fluid is pumped down a tubing string and the produced liquid is pumped up the casing-tubing annulus. The stroke in a hydraulic pump is very similar to a sucker-rod pump stroke except it is shorter. Hydraulic pumps can be either fixed (screwed onto the tubing string) or free (pumped up and down the well). They can also be either open (with downhole mixing of power and produced fluids) or closed (with no mixing). Most are free and open.

Known pumps used in artificial lift methods suffer from a number of problems/disadvantages—e.g. low efficiency (hydraulic efficiency).

It is an object of at least one aspect of the present invention to obviate or mitigate one or more of the aforementioned problems/disadvantages in the prior art.

It is a further object of at least one embodiment of the present invention to provide a pump which provides a positive displacement of a predetermined volume of well production fluid for each operative cycle of the pump—in contra-distinction to pumps of the prior art which provide axial flow of well production fluid.

SUMMARY OF THE INVENTION

According to a first aspect of the present invention there is provided a pump providing a chamber having a volume, an inlet to the chamber, an outlet from the chamber, and means for varying the volume of the chamber.

The pump may be adapted to be used downhole—e.g. in an oil/gas well.

The means for varying the volume of the chamber may be controlled by relative rotation of first and second bodies of the pump.

In a first embodiment the second body may be provided within the first body and may be substantially concentric therewith.

In a second embodiment the second body may be provided within the first body and may be substantially eccentric therewith.

The chamber may be provided within the second body, and preferably longitudinally within the second body.

The first and second bodies may each be of an elongate form.

The second body may comprise a rotor.

The first body may comprise a stator.

The means for varying the volume of the chamber may include at least one piston supported by the second body and biased by means towards the first body.

A first end of the/each piston may communicate with the chamber while a second end of the/each piston may be urged by biassing means into contact with an inner surface of the stator.

Relative rotation of the first and second bodies may cause movement of the piston(s) thereby varying the volume of the chamber.

In the first embodiment the first body may have a substantially elliptical (or oval) internal bore. Further the second body may provide a substantially cylindrical or optionally elliptical outer surface.

Alternatively, the first body may have a substantially cylindrical internal bore and the second body may provide a substantially elliptical outer surface.

Further the means for varying the volume of the chamber may include at least one piston supported by the first body and biased by means towards the second body.

In the second embodiment the first body may have a substantially cylindrical internal bore. Further the second body may provide a substantially cylindrical outer surface.

The inlet may include a first one-way valve and perhaps one or more back-up valves.

The outlet may include a second one-way valve and perhaps one or more back-up valves.

There may be provided at least one pair of pistons supported by, and preferably provided substantially within, the second body and radially opposing one another relative thereto.

There may be provided a plurality of pair of pistons, each pair being longitudinally spaced from an adjacent pair along the second body.

The/each piston may include a rotatable member free to rotate at least along a longitudinal axis with respect to the rotor.

The/each piston may also include a piston member.

The piston member may include a concave portion capable of receiving at least a portion of the rotatable member.

In one embodiment each rotatable member may be in the form of a sphere, e.g. a ball bearing.

In an alternative embodiment each rotatable member may be in the form of a cylinder, e.g. a rod (roller).

The means for varying the volume of the chamber may be driven by any suitable drive means—e.g. hydraulic, pneumatic, or electric.

The drive means may include a drive shaft for rotating the rotor, in use.

Preferably the rotor may be provided with at least one seal (or bushing) for sealing engagement with the stator.

Preferably the/each seal is/are made from a material selected from the group consisting of plastics materials, polyethylethylketone, metal, copper alloys and stainless steel.

Preferably the piston member(s) is/are made from a material selected from the group consisting of plastics materials, polyethylethylketone, metal, copper alloys and stainless steel. The piston(s) may be hollow, spherical, cylindrical, cuboid or polygonal.

Preferably the rotatable member(s) is/are made from a material selected from the group consisting of plastics materials, polyethylethylketone, metal, copper, alloys and stainless steel. The rotatable member(s) may be hollow, spherical or cylindrical.

Preferably the/each biassing means, e.g. spring(s), is/are made from a material selected from the group consisting of plastics materials, polyethylethylketone, metal, copper alloys and stainless steel.

Preferably the rotor is provided with at least two piston apertures which are disposed substantially opposite one another, each of the piston apertures being provided with a respective piston.

Preferably each piston may have a slot, hole or gap to allow fluid to flow through the piston from the chamber, i.e. rotor channel, which fluid flow may assist in lubricating contacting surfaces of the piston(s) and the stator and the piston(s) and the rotor.

In a preferred embodiment the pump may comprise/include 24 pistons and respective biassing means, wherein each piston and biassing means may work individually in series, or in parallel with one another. This feature is particularly beneficial in seeking to allow continuous flow of drive fluid through the pump, thereby, for example, obviating or mitigating hydraulic hose vibration.

The rotor may be provided with a plurality of pistons arranged in pairs, each aperture of each pair being substantially opposite to the other.

In a preferred embodiment one biassing means may be used for each piston of a pair by traversing the chamber/rotor channel, but not cutting off fluid flow through the chamber.

In a preferred embodiment one or more one valves may be used for the inlet of the pump, and one or more one way valves may be used for the outlet of the pump, allowing fluid flow to travel through the chamber.

According to a second aspect of the present invention, there is provided a plurality of pumps according to the first aspect so arranged as to be operating connected with one another.

The pumps may operate in phase with one another and may not be separated by a one-way valve(s).

Alternatively, the pumps may be arranged so that, in use the pumps operate out of phase with one another. Thus two pumps with two chambers each may be connected 90 degrees out of phase with one another. Alternatively, two pumps each with four chambers may be connected 45 degrees out of phase. Arrangements such as these help to ensure a smooth output and inhibit drive motor stalling.

At least one first vent hole may be manufactured at a desired position through the stator, allowing any pressure differential across the stator to be equalised, and held to the pressure external to the pump.

The rotor may be provided within at least one bearing pack which may include at least one radial bearing and at least one thrust bearing. The bearing pack may include at least one seal at a fluid upstream end and at least one seal at a fluid downstream section end of the bearing pack(s).

At least one second vent hole may be manufactured at a desired position through a bearing housing, allowing any pressure differential across the bearing pack(s) to be equalised, and held to the pressure external to the pump.

The rotor may be connected to a drive by means of a spline, hex, polygon or other similar coupling.

According to a third aspect of the present invention there is provided a well completion including at least one pump, the at least one pump providing a chamber having a volume, an inlet to the chamber, and an outlet from the chamber, and means for varying the volume of the chamber.

According to a fourth aspect of the present invention there is provided a method of artificial lift within an oil/gas well comprising the steps of:

lowering a pump to a desired position within a borehole of a well, the pump providing a chamber having a volume, an inlet to the chamber, an outlet from the chamber and means for varying the volume of the chamber;

driving the pump by varying the volume of the chamber thereby pumping well fluids downstream through the pump and a tubing of the well.

Herein the term upstream is intended to mean closer to the well source, and downstream is intended to mean nearer to surface.

According to a fifth aspect of the present invention there is provided a pump including an inlet, a filter means associated with the inlet, and means for cleaning the filter means.

The filter means may comprise a substantially cylindrical body and may carry an end plate.

The filter means may be formed from a sheet form mesh material.

The means for cleaning the filter means may be driven by means by which the pump is driven.

The pump may provide a chamber having a volume, an inlet communicating with the chamber, and further an outlet from the chamber, and means for varying the volume of the chamber.

The means for varying the volume of the chamber may be controlled by relative rotation of first and second bodies of the pump.

The first and second bodies may comprise a stator and a rotor, respectively.

In one embodiment, the filter means may be rigidly attached to the rotor so as to rotate therewith.

The means for cleaning may comprise at least one blade, knife or scraper, to be known hereinbelow as the blade(s), rigidly attached to the stator.

The blade(s) may have a serrated edge or surface which, when coming into contact with the filter means, in use, may allow any debris or contamination build up on the filter means to be removed.

Preferably the filter means is/are made from a material selected from the group consisting of plastics materials, polyethylethylketone, metal, copper alloys and stainless steel.

Preferably the blade(s) is/are made from a material selected from the group consisting of plastics materials, polyethylethylketone, metal, copper alloys and stainless steel.

BRIEF DESCRIPTION OF THE DRAWINGS

Embodiments of the present invention will now be described by way of example only, with reference to the accompanying drawings, which are.

DETAILED DESCRIPTION OF THE DRAWINGS

Figure 1:
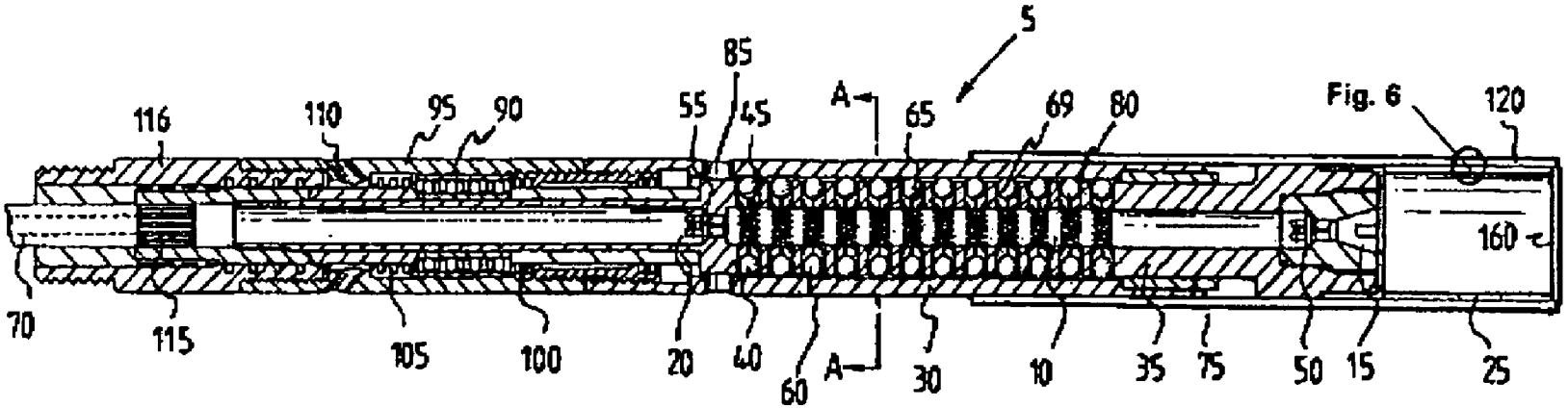
FIG. 1 a detailed sectional side view of a pump according to a first embodiment of the present invention.
Figure 3:
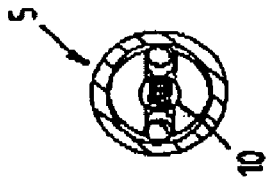
FIG. 3 a detailed sectional view along line A—A of FIG. 1 in a second position.
Figure 2:
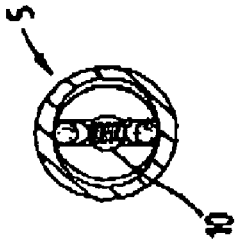
FIG. 2 a detailed sectional view along line A—A of FIG. 1.

Referring initially to FIGS. 1 to 3 there is shown a pump, generally designated 5, according to a first embodiment of the present invention. The pump 5 provides a chamber 10, having a volume V, an inlet 15 to the chamber 10 an outlet 20 from the chamber 10, and means for varying the volume V of the chamber 10, which will be described in greater detail hereafter.

Figure 6:
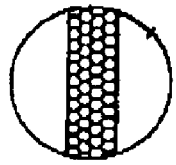
FIG. 6 an enlarged view of the filter means associated with the inlet of the pump of FIG. 1.

Referring to FIG. 6, the pump 5 includes filter means 25 associated with the inlet 15 and means for cleaning the filter means 25, which will also be described in greater detail hereinafter. The filter means 25 are rigidly attached to the rotor 35.

The pump 5 of this embodiment is adapted to be used downhole—e.g. in an oil/gas well.

The means for varying the volume V of the chamber 10 is controlled by relative rotation of first and second elongate bodies—comprising a stator 30 and a rotor 35 respectively—of the pump. In this embodiment the rotor 35 is provided within the stator 30, substantially concentric therewith. The chamber 10 is provided longitudinally within the rotor 35. The means for varying the volume V of the chamber 10 includes a plurality of pistons 40 supported by the rotor 35 and biassed towards an inner surface of the stator 30.

A first end of each piston 40 communicates with the chamber 10 while a second end of each piston 40 is urged by biassing means such as a coiled spring 45 into contact with the inner surface of the stator 30.

As can be seen from FIGS. 2 and 3, the stator 30 has a substantially elliptical or oval internal bore. Further the rotor 35 provides a substantially cylindrical outer surface.

Relative rotation of the stator 30 and rotor 35 thus causes movement of the pistons 40 thereby varying the volume V of the chamber 10.

The inlet 15 includes a first one-way valve 50 while, the outlet 20 includes a second one-way valve 55.

As can be seen from FIGS. 1 to 3, there are provided a plurality of pairs of pistons 40 supported by and provided substantially within the rotor 35, and radially opposing one another relative thereto. Each pair of pistons 40 are longitudinally spaced from an adjacent pair along the rotor 35.

Each piston 40 includes a rotatable member 60 free to rotate at least longitudinally with respect to a piston member 65. The piston member 65 includes a concave portion 69 capable of receiving at least a portion of the rotatable member 60. In this embodiment each rotatable member 60 is in the form of a sphere, e.g. a ball bearing.

In an alternative embodiment each rotatable member 60 may be in the form of a cylinder, e.g. a rod (roller).

The means for varying the volume V of the chamber 10 are driven by any suitable drive means—e.g. hydraulic, pneumatic, or electric. The drive means includes a drive shaft 70 for rotating the rotor 35 in use.

The rotor 35 is provided with at least one seal (or bushing) 75 for sealing engagement with the stator 30. The/each seal 75 is made from a material selected from the group consisting of plastics materials, polyethylethylketone, metal, copper alloys and stainless steel.

Further the piston members 65 are made from a material selected from the group consisting of plastics, polyethylethylketone, metal, copper alloys and stainless steel.

Yet further the rotable members 60 are made from a material selected from the group consisting of plastics materials, polyethylethylketone, metal, copper alloys and stainless steel.

Further also springs 45 are made from a material selected from the group consisting of plastics materials, polyethylethylketone, metal, copper alloys and stainless steel.

The rotor 35 is provided with pairs of piston apertures 80, each of the piston apertures 80 being provided with a respective piston 40.

As can be seen from FIG. 1 each piston member 65 has a slot, hole or gap to allow fluid to bleed through the piston member from the chamber 10, i.e. channel, which fluid flow assists in lubricating contacting surfaces body of each piston 40 and the stator 30.

In this embodiment the pump 5 may comprise/include 24 pistons 40 and 12 coiled springs 45. This feature is particularly beneficial in seeking to allow continuous flow of drive fluid through the pump 5, thereby, for example, obviating or mitigating hydraulic hose vibration.

The rotor 35 is provided with a plurality of pistons 40 arranged in pairs, each aperture 80 of each pair being substantially opposite to the other.

Further, one coiled spring 45 is used for each piston 40 of a pair by traversing the chamber 10—but not cutting off fluid flow through the chamber 10.

In a modified embodiment more than one one way valve may be provided at the inlet 15 of the pump 5, and more than one one way valve may be provided at the outlet 20 of the pump 5 allowing fluid flow to travel through the chamber 10.

It will be appreciated that a plurality of pumps 5 according to the invention may be so arranged as to be operated connected with one another.

Figures 6, 7:
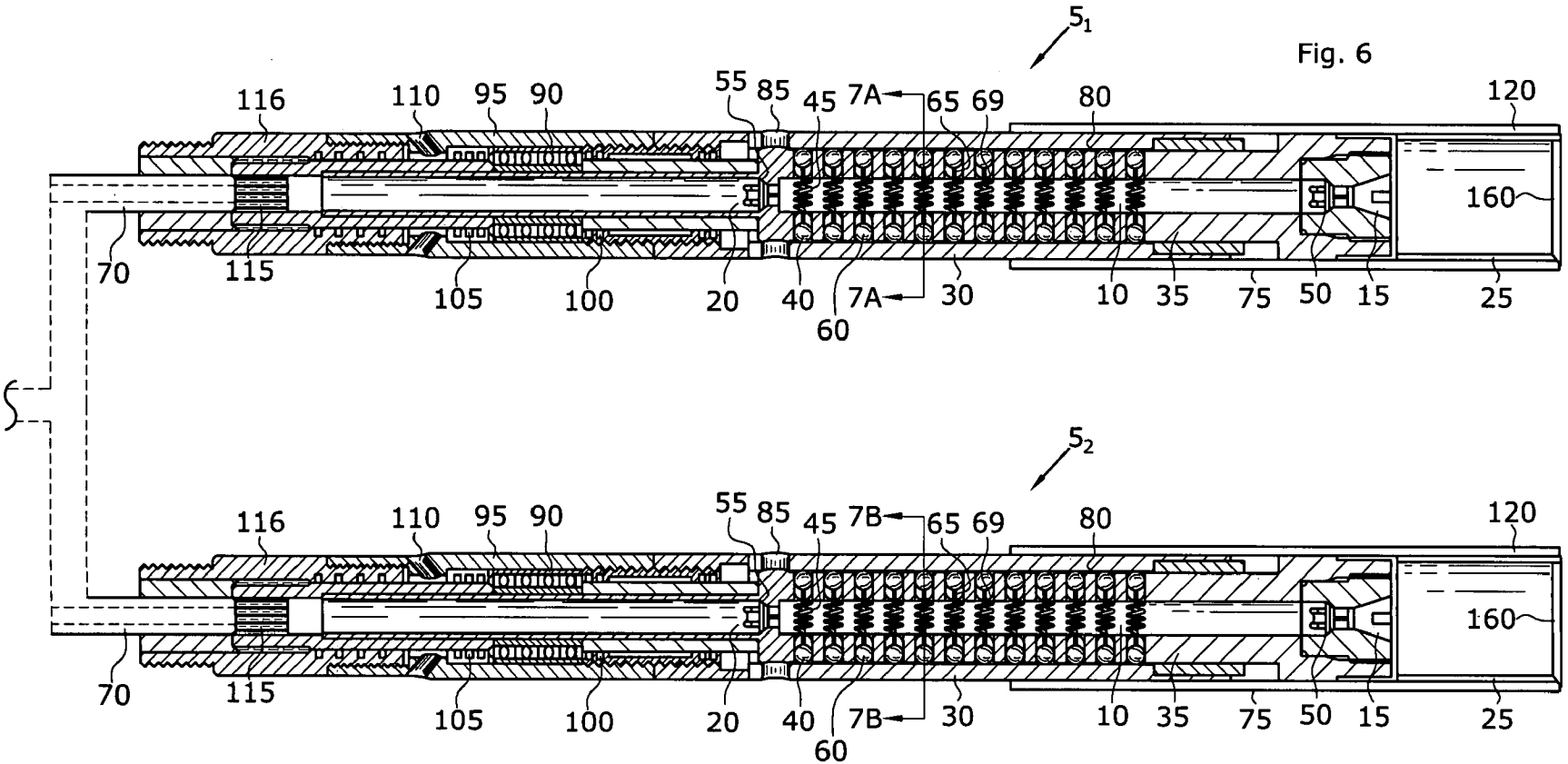
FIG. 7 a detailed sectional side view of a plurality of pumps operatively connected to each other according to an alternate embodiment of the present invention.
Figure 7A:
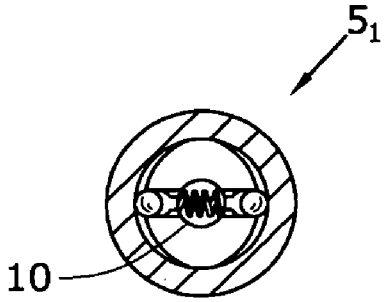
FIGS. 7A, 7B detailed cross-sectional views of pumps $\mathbf{5}_1$, taken along line A—A of FIG. 7, and $\mathbf{5}_2$, taken along line B—B of FIG. 7, showing that the two pumps are 90 degrees out of phase with each other.
Figure 7B:
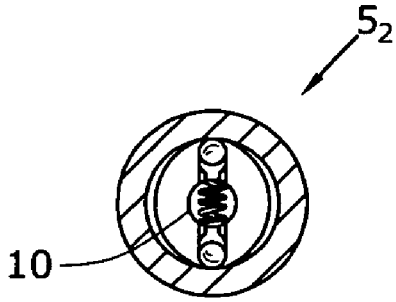
Figure 7C:
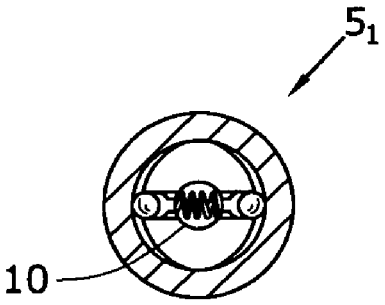
FIGS. 7C, 7D detailed cross-sectional views of pumps $\mathbf{5}_1$, taken along line A—A of FIG. 7, and $\mathbf{5}_2$, taken along line B—B of FIG. 7, showing that the two pumps are 45 degrees out of phase with each other.
Figure 7D:
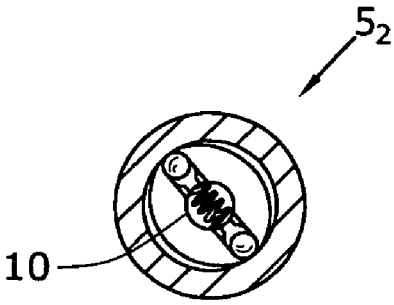
Figure 8:
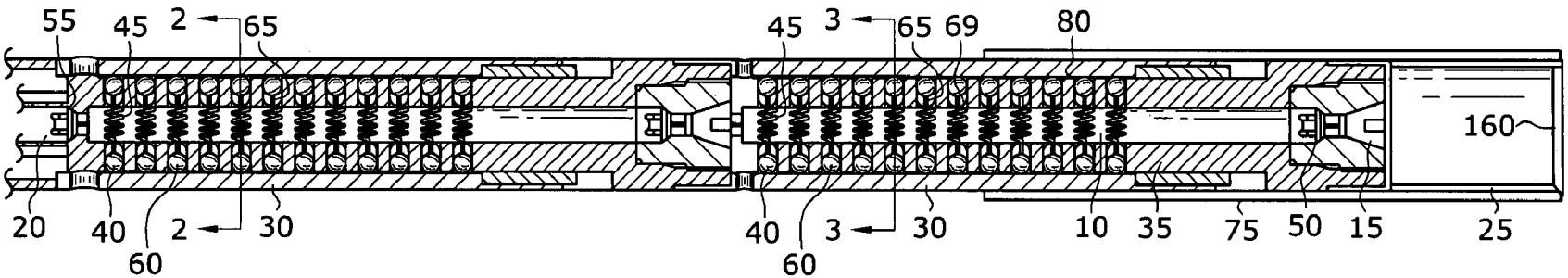
FIG. 8 a detailed sectional side-view of a pump according to the present invention having several chambers.

For example, the pumps may be arranged so that in use, the pumps operate out of phase with one another. Thus two pumps, as illustrated in FIG. 7, with two chambers each may be connected 90 degrees out of phase with one another, as illustrated in FIG. 7A. Alternatively, two pumps each with four chambers may be connected 45 degrees out of phase, as illustrated in FIG. 7B. Arrangements such as these to help to ensure a smooth output and inhibit motor stalling. FIG. 8 further illustrates how pump 5 can include multiple chambers.

Referring to FIG. 1, at least one first vent hole 85 is provided through the stator 30, allowing any pressure differential across the stator 30 to be equalised, and held to the pressure external to the pump 5.

The rotor 35 is provided within a bearing pack 90 held within a bearing housing 95, the pack 90 including at least one radial bearing and at least one thrust bearing 90, and at least one seal 100 upstream and at least one seal 105 downstream of the bearing pack 90.

The bearing pack 90 includes at least one second vent hole 110 provided through the bearing housing 95, allowing any pressure differential across the radial bearing(s) and thrust bearing(s) to be equalised, and held to the pressure external to the pump 5.

The rotor 35 is connected to a drive means including drive shaft 70 by a coupling 115, e.g. a spline, hex or other similar coupling provided with a drive housing 116.

Referring to FIG. 1, the means for cleaning the filter means 25 are driven by means by which the pump 5 is driven. The filter means 25 comprises a substantially cylindrical body made of a sheet mesh, and carries an end plate 160. The cleaning means comprise a pair of elongate blades 120 rigidly attached to the stator 30. The blades 120 may have a serrated edge 120, as illustrated in FIG. 6, or surface which, when coming into contact with the filter means 25, in use, allow any debris or contamination build up on the filter means 25 to be removed.

The filter means 25 is made from a material selected from the group consisting of plastics materials, polyethylethylketone, metal, copper alloys and stainless steel.

The blades 120 are made from a material selected from the group consisting of plastics materials, polyethylethylketone, metal, copper alloys and stainless steel.

In use, the rotor 35 is rotated via the drive means including driveshaft 70. Well fluid is caused to pass through the filter 25 while the rotor 35 rotates. The blades 120 which may be stationary relative to the filter means 25 constantly clean the filter means 25. The filtered fluid then passes through the inlet 15 and first one way valve 50.

The fluid then enters the chamber 10 (aided by a possible positive differential surrounding/external pressure) when the pistons 40, in their maximum extended positions, are shown in a non-power position, as shown in FIG. 3. As the rotor 35 is driven through 90 degrees, as in FIG. 2, the pistons 40 are forced inwards due to the internal elliptical shape of the stator 30 thus compressing the fluid within the chamber 10. The resulting pressure change within the chamber 10 forces the first one way valve 50 shut and the second one way valve 55 open allowing fluid to flow through the chamber 10 within the bearing housing 95 and to surface. This process is cyclical and occurs twice per revolution.

It is envisaged that the embodiment of the invention described above, which may represent a 3⅛" diameter of pump 5, may supply fluid at an approximate working pressure of 5000 PSI and a flowrate of approximately 23.16 liters per minute which is equal to 210 US barrels per day.

For the disclosed 24 piston embodiment the flow rate Q may be calculated from:

$$Q = \begin{matrix}\text{NUMBER}\\ \text{OF}\\ \text{PISTONS}\end{matrix} \times \begin{matrix}\text{CYCLES PER}\\ \text{REVOLUTION}\\ \text{OF ROTOR}\end{matrix} \times \left[\frac{\Pi}{4} \times \left[\begin{matrix}\text{DIAMETER OF}\\ \text{CHANNEL}\end{matrix}\right]^2\right] \times \begin{matrix}\text{STROKE}\\ \text{DISTANCE}\\ \text{BALL BEARINGS}\\ \text{MOVE}\end{matrix}$$

Figure 4:
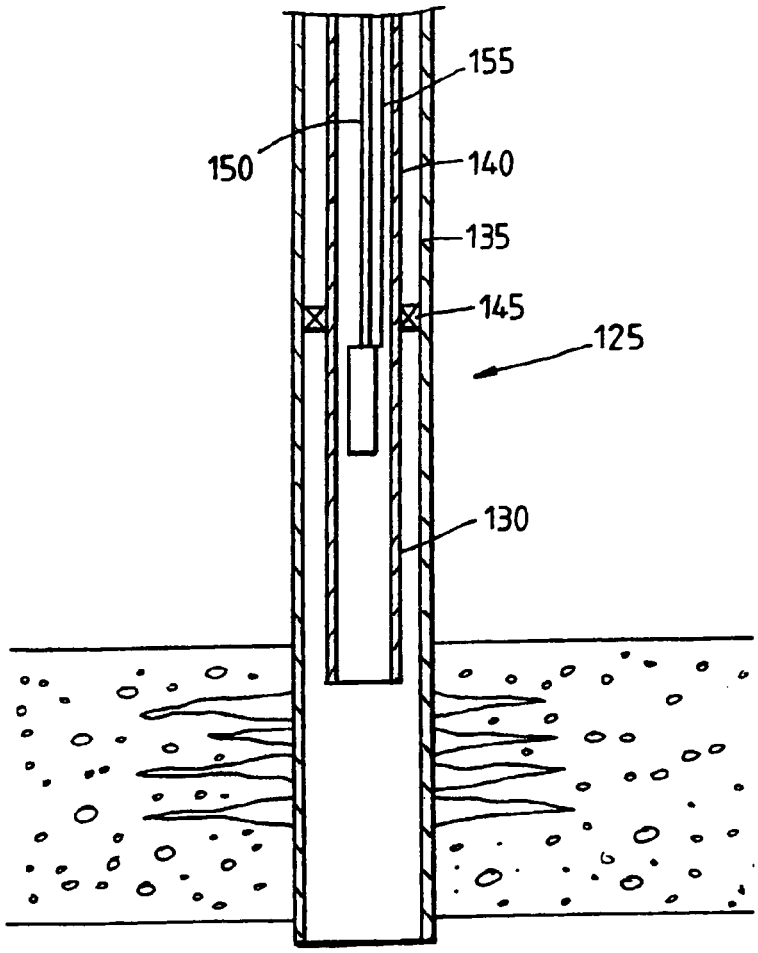
FIG. 4 a schematic sectional side view of a well completion including a pump according to FIG. 1.

Referring to FIG. 4 there is shown a well completion, generally designated 125, comprising a borehole 130 having a casing 135. Within the casing 135 there is provided a production tubing 140, and between the casing 135 and tubing 140 one or more packers 145.

When it is desired to provide artificial lift a pump 5 is lowered down within tubing 140 to a desired position on coiled tubing 150 or the like.

The pump 5 may be driven via power line 155 which may be a hydraulic or electric line suitable for driving the drive means to which the rotor 35 is connected. In use, therefore, well produce is delivered to the surface via the coiled tubing 150.

Figure 5:
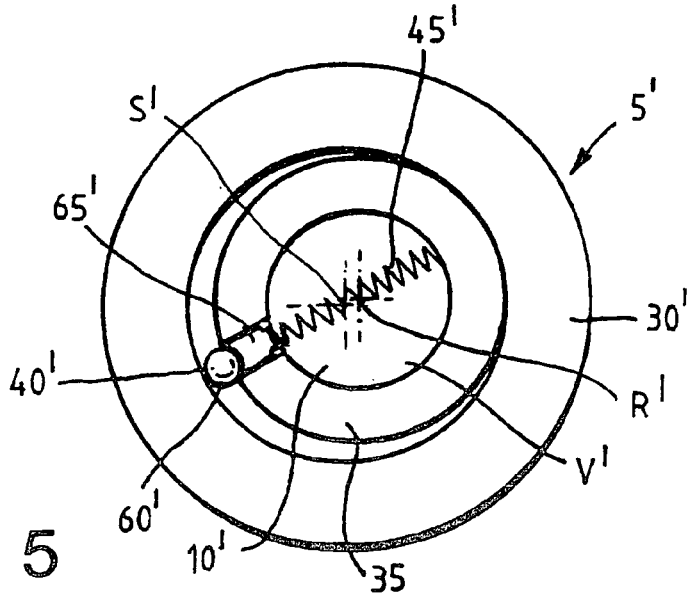
FIG. 5 a detailed cross-sectional view from the top of a second embodiment of the present invention.

Referring now to FIG. 5 there is shown a pump, generally designated 5', according to a second embodiment of the present invention. Like parts of the pump 5' are identified by the same numerals as for the pump 5 of the first embodiment, but suffixed "'".

In the pump 5' the first elongate body comprises a stator 30' and the second elongate body comprises a rotor 35'. As be seen from FIG. 5 the rotor 35' is provided within the stator 30' but longitudinally eccentric relative thereto. Further, the stator 30' has a substantially cylindrical inner bore, while the rotor 35' also has a substantially cylindrical outer surface.

The stator 30' has a central axis "S'", while the rotor has a central axis "R'".

By this arrangement relative rotations of the rotor 35' and stator 30' causes movement of the piston(s) 40 thereby causing the volume V' of the chamber 10' to be varied.

It will be appreciated that the embodiments of the invention hereinbefore described are given by way of example only, and are not meant to limit the scope thereof in any way.

Particular advantages of the disclosed embodiments will be appreciated. For example, the disclosed pump is completely mechanical and is a metal based device.

What is claimed is:

1. A downhole pump comprising: a first body comprising a stator, a second body comprising a rotor, the rotor being provided within the stator and carrying at least one piston, a chamber within the rotor, an inlet to the chamber provided at an upstream end of the chamber, and an outlet from the chamber provided at a downstream end of the chamber, the at least one piston being provided longitudinally between the inlet and the outlet, the at least one piston comprising a means for varying a volume of the chamber, and the at least one piston being mounted in a respective aperture passing through a side wall of the rotor, the respective aperture being substantially transverse to a longitudinal axis of the pump, wherein, in use, relative rotation of the rotor and the stator causes reciprocal movement of the at least one piston within the respective aperture thereby varying the volume of the chamber, whereby well production fluid is caused to be pumped downstream through the chamber.

2. A downhole pump as claimed in claim 1, wherein relative rotation of the rotor and stator occurs, in use, along a longitudinal axis of the rotor or the stator.

3. A downhole pump as claimed in claim 1, wherein the first and second bodies are substantially concentric one with the other.

4. A downhole pump as claimed in claim 1, wherein the first and second bodies are substantially eccentric relative to one another.

5. A downhole pump as claimed in claim 1, wherein the chamber is provided substantially longitudinally within the second body.

6. A downhole pump as claimed in claim 1, wherein the at least one piston is supported by the second body and biased by means towards the first body.

7. A downhole pump as claimed in claim 6, wherein the first end of the at least one piston communicates with the chamber and a second end of the at least one piston is urged by the respective biasing means into contact with an inner surface of the first body.

8. A downhole pump as claimed in claim 7, wherein the biasing means are made from a material selected from the group consisting of: plastics materials, polyethylethylketone, metal, copper alloys and stainless steel.

9. A downhole pump as claimed in claim 1, wherein the first body has a substantially elliptical, oval or cylindrical inner surface.

10. A pump as claimed in claim 9, wherein the second body has a substantially cylindrical or elliptical outer surface.

11. A downhole pump as claimed in claim 1, wherein the bore comprises a substantially cylindrical internal bore.

12. A downhole pump as claimed in claim 1, wherein the means for varying the volume of the chamber comprises the at least one piston which is supported by the second body and biased by means towards the first body.

13. A downhole pump as claimed in claim 1, wherein the inlet includes a first valve means.

14. A downhole pump as claimed in claims 13, wherein the inlet also includes one or more back-up valves.

15. A downhole pump as claimed in claim 1, wherein the outlet includes a second valve means.

16. A downhole pump as claimed in claim 15, wherein the outlet also includes one or more back-up valves.

17. A downhole pump as claimed in claim 1, wherein there is provided at least one pair of pistons supported by the second body and radially opposing one another relative thereto.

18. A downhole pump as claimed in claim 17, wherein there are provided a plurality of pairs of pistons, each pair being longitudinally spaced from an adjacent pair along the second body.

19. A downhole pump as claimed in claim 1, wherein the at least one piston includes a rotatable member free to rotate at least along a longitudinal axis with respect to the rotor.

20. A downhole pump as claimed in claim 19, wherein the at least one piston includes a piston member, the piston member including a concave portion capable of receiving at least a portion of the rotatable member.

21. A downhole pump as claimed in claim 20, wherein each rotatable member is in the form of a cylinder.

22. A downhole pump as claimed in claim 20, wherein the piston member is made from a material selected from the group consisting of: plastics materials, polyethylethylketone, metal, copper alloys and stainless steel.

23. A downhole pump as claimed in claim 19, wherein each rotatable member is in the form of a sphere.

24. A downhole pump as claimed in claim 19, wherein the rotatable member is made from material selected from the group consisting of: plastics materials, polyethylethylketone, metal, copper alloys and stainless steel.

25. A downhole pump as claimed in claim 19, wherein the rotatable member is hollow, spherical or cylindrical.

26. A downhole pump as claimed in claim 1, wherein the means for varying the volume of the chamber is driven by drive means.

27. A downhole pump as claimed in claim 26, wherein the drive means includes a drive shaft for rotating the rotor, in use.

28. A downhole pump as claimed in claim 26, wherein the drive means is selected from a hydraulic, pneumatic or electric drive means.

29. A downhole pump as claimed in claim 28, wherein the means for cleaning comprise at least one blade, knife or scraper substantially rigidly attached to the stator.

30. A downhole pump as claimed in claim 29, wherein the least one blade has a serrated edge or surface which, when coming into contact with the filter means, in use, act to allow any debris or contamination build upon the filter means to be removed.

31. A downhole pump as claimed in claim 29, wherein the at least one blade is made from a material selected from the group consisting of: plastics materials, polyethylethylketone, metal, copper alloys and stainless steel.

32. A downhole pump as claimed in claim 1, wherein the rotor is provided with at least one seal or bushing for sealing engagement with the stator.

33. A downhole pump as claimed in claim 32, wherein the at least one seal is made from a material selected from the group consisting of plastics materials, polyethylethylketone, metal, copper alloys and stainless steel.

34. A downhole pump as claimed in claim 1, wherein the at least one piston is hollow, spherical, cylindrical, cuboid or polygonal.

35. A downhole pump as claimed in claim 1, wherein the rotor is provided with at least two piston apertures which are disposed substantially opposite one another, each of the piston apertures being provided with a respective piston.

36. A downhole pump as claimed in claim 35, wherein each piston has a slot, hole or gap to allow fluid to flow through the piston from the chamber, which fluid flow assists in lubricating contacting surfaces of the at least one piston and the stator and the at least one piston and the rotor.

37. A downhole pump as claimed in claim 1, wherein the pump comprises or includes a plurality pistons and respective biasing means, wherein each piston biasing means works individually in series or in parallel with one another.

38. A downhole pump as claimed in claim 37, wherein the second body is provided with a plurality of pistons arranged in pairs, each aperture of each pair being substantially opposite to the other.

39. A downhole pump as claimed in claim 38, wherein one biasing means is used for each piston of a pair by traversing the chamber but not cutting off fluid flow through the chamber.

40. A downhole pump as claimed in claim 1, wherein one or more one way valves are provided at the inlet and one or more further one way valves are provided at the outlet of the pump allowing fluid flow to travel through the chamber.

41. A downhole pump as claimed in claim 1, wherein at least one first vent hole is provided at a predetermined position through the first body, allowing any pressure differential across the first body to be equalised and held to the pressure external to the pump in use.

42. A downhole pump as claimed in claim 41, wherein the second body is provided within at least one bearing pack which includes at least one radial bearing and at least one thrust bearing.

43. A downhole pump as claimed in claim 42, wherein the bearing pack includes at least one seal at a fluid upstream end and at least one seal at a fluid downstream section end of the least one bearing pack.

44. A downhole pump as claimed in claim 42, wherein at least one second vent hole is provided at a predetermined position through a beating housing, allowing any pressure differential across the bearing pack(s) to be equalised and held to the pressure external to the pump in use.

45. A downhole pump as claimed in claim 1, wherein the rotor is connected to a drive means by a spline, hex or polygon coupling.

46. A downhole pump as claimed in claim 1, wherein there is provided a filter means associated with the inlet and means for cleaning the filter means.

47. A downhole pump as claimed in claim 46, wherein the filter means comprises a substantially cylindrical body.

48. A downhole pump as claimed in claim 46, wherein the filter means carries an end plate.

49. A downhole pump as claimed in claim 46, wherein the filter means is formed from a sheet form mesh material.

50. A downhole pump as claimed in claim 46, wherein the means for cleaning the filter means is driven by a drive means.

51. A downhole pump as claimed in claim 46, wherein the filter means is rigidly attached to the second body so as to rotate therewith, in use.

52. A downhole pump as claimed in claim 46, wherein the filter means is made from a material selected from the group consisting of: plastics materials, polyethylethylketone, metal, copper alloys and stainless steel.

53. A downhole assembly comprising a plurality of downhole pumps, each pump comprising a pump according to claim 1, the plurality of pumps being so arranged as to be operatively connected with one another.

54. A downhole assembly as claimed in claim 53, wherein the pumps are arranged so that, in use, the pumps operate substantially in phase with one another and are not separated by a one way valve(s).

55. A downhole assembly as claimed in claim 53, wherein the pumps are arranged so that, in use, the pumps operate substantially out of phase with one another.

56. A downhole assembly as claimed in claim 55, wherein two pumps with two chambers are connected 90 degrees out of phase with one another.

57. A downhole assembly as claimed in claim 55, wherein two pumps each with four chambers are connected 45 degrees out of phase.

58. A well completion including at least one downhole pump according to claim 1.

59. A method of artificial lift within an oil/gas well comprising the steps of:

providing at least one downhole pump according to claim 1;

lowering the at least one downhole pump to a desired position within a borehole of a well;

driving the at least one downhole pump so varying the volume of the chamber therein, thereby pumping well fluids downstream through the at least one pump and a tubing of the well.

60. A method of artificial lift as claimed in claim 59, wherein the tubing comprises coiled tubing upon which the at least one downhole pump is lowered within the borehole.

* * * * *